US007469797B2

(12) United States Patent
Li

(10) Patent No.: US 7,469,797 B2
(45) Date of Patent: Dec. 30, 2008

(54) BASKET AND METHOD OF MAKING BASKET

(76) Inventor: Guang Yang Li, 218 Merrill St., Syracuse, NY (US) 13208

( * ) Notice: Subject to any disclaimer, the term of this patent is extended or adjusted under 35 U.S.C. 154(b) by 513 days.

(21) Appl. No.: 10/820,318

(22) Filed: Apr. 8, 2004

(65) Prior Publication Data

US 2005/0224463 A1 Oct. 13, 2005

(51) Int. Cl.
*B65D 25/04* (2006.01)

(52) U.S. Cl. ..... 217/122; 220/771

(58) Field of Classification Search ..... 217/122, 217/126, 125; 220/771; 47/65.7, 72
See application file for complete search history.

(56) References Cited

U.S. PATENT DOCUMENTS 767,175 A * 8/1904 Sibole ..... 47/72
3,506,154 A * 4/1970 Barnes ..... 220/645
6,382,279 B1 * 5/2002 Vaisanen ..... 144/353
6,896,148 B2 * 5/2005 Whyte ..... 217/122

* cited by examiner

*Primary Examiner*—Anthony D Stashick
*Assistant Examiner*—Harry A Grosso
(74) *Attorney, Agent, or Firm*—Raymond Y. Chan; David and Raymond Patent Firm

(57) ABSTRACT

A basket is disclosed formed from a portion of a tree. The portion may be a portion of a trunk or a branch of a tree. The basket is formed so that it retains at least part of a natural outer form of the portion of the tree. The natural outer form may be the natural outer form of bark of the portion of the tree or may be the natural outer form of an inner wood section lying directly underneath the bark of the tree. The basket may include an integral handle. The basket may have a bottom, which is formed by cutting. A method is provided including removing a portion of a tree, wherein the portion includes a bark section and an inner wood section, wherein the inner wood section is surrounded by the bark section. A basket may be formed having an outer surface including a natural outer form of the portion of the tree.

8 Claims, 5 Drawing Sheets

BASKET AND METHOD OF MAKING BASKET

FIELD OF THE INVENTION

This invention relates to improved methods and apparatus concerning basket making.

BACKGROUND OF THE INVENTION

There are various known techniques for making baskets.

SUMMARY OF THE INVENTION

The present invention in one or more embodiments provides an apparatus. The apparatus comprises a basket formed from a portion of a tree so that at least part of the basket retains a natural outer form of the portion of the tree. The portion of the tree may be a portion of a trunk of the tree or a portion of a branch of a tree. The natural outer form may be the natural outer form of a bark section of the portion of the tree, or the natural outer form of an inner wood section lying directly beneath a bark section of the portion of the tree. The natural outer form of the inner wood section can be seen by simply peeling off the bark section. The basket may include an integral handle. The basket may have a bottom, which is formed by cutting.

The present invention in one or more embodiments also includes a method comprising removing a portion of a tree, wherein the portion includes a bark section and an inner wood section, wherein the inner wood section is surrounded by the bark section. The bark section has a natural outer form. The inner wood section also has a natural outer form, which lies directly beneath the bark section, and can be seen by simply peeling off the bark section. The method may further include forming a basket from the portion of the tree. The basket may or may not have the bark removed. The basket typically retains the natural outer form of the inner wood section or the natural outer form of the bark section.

DETAILED DESCRIPTION OF THE DRAWINGS

Figure 1:
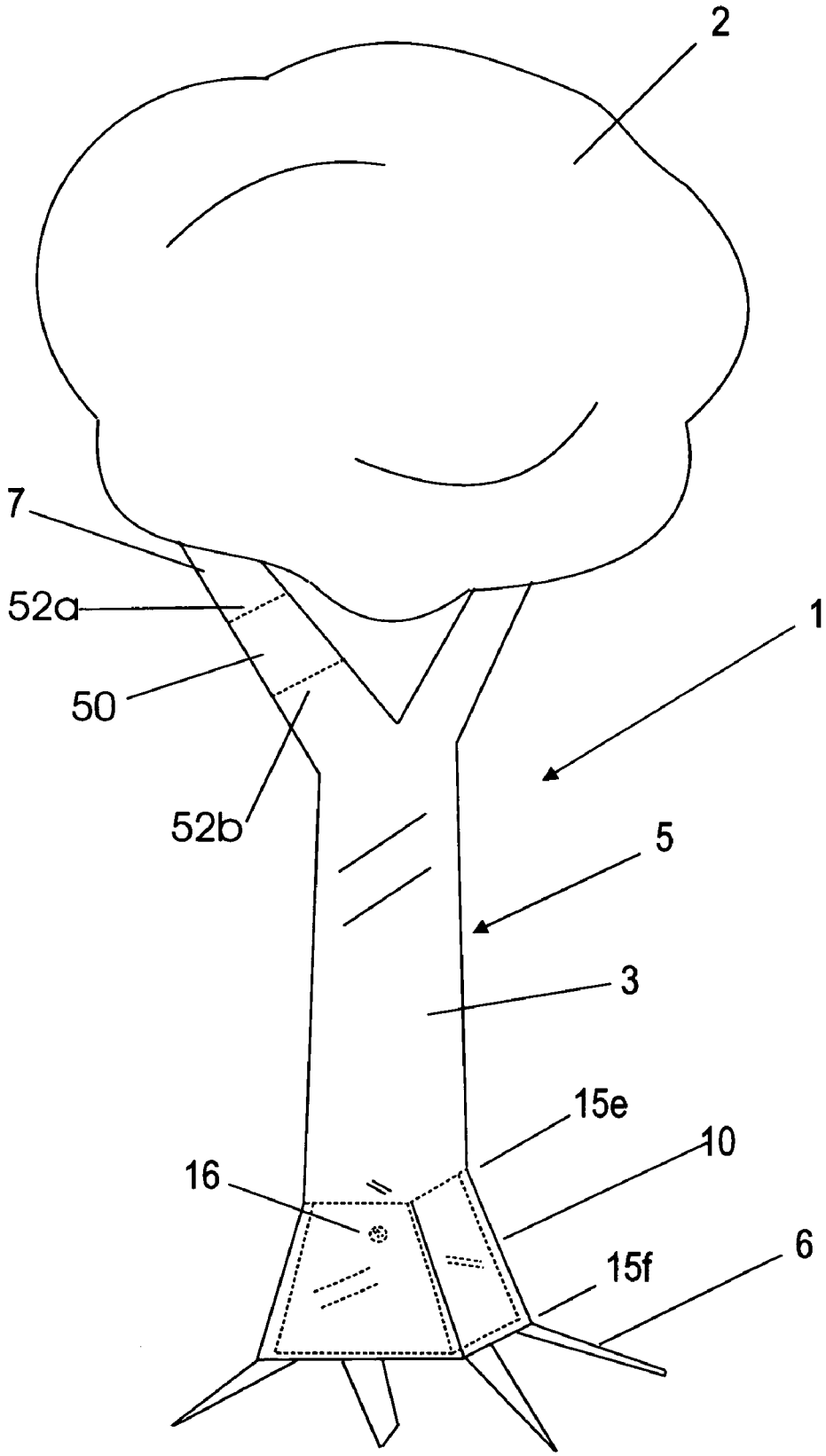
FIG. 1 shows a diagram of a tree including portions of a tree for use in accordance with an embodiment of the present invention.

FIG. 1 shows a diagram of a tree 1 including a portion 10 of a tree trunk 5 for use in accordance with an embodiment of the present invention and including a portion 50 of a branch 7 for use with another embodiment of the present invention. The tree 1 includes leaves and/or branches 2, trunk 5, roots 6, and branch 7. The trunk 5 includes portions 3 and 10. The portion 10 has bark 12. The bark 12 of portion 10 is shown by solid lines, while an inner wood portion of the portion 10 is shown by dashed lines. The bark 12 has a natural outer form. The inner wood portion has a natural outer form or shape, directly beneath the bark 12, shown by the dashed lines, which includes bump or knot 16. The natural outer form of the inner wood portion, although shown for simplification by using straight dashed lines (except for bump or knot 16), will typically have curves, nonuniformities, bumps, ridges, knots, imperfections, etc.

Figure 2A:
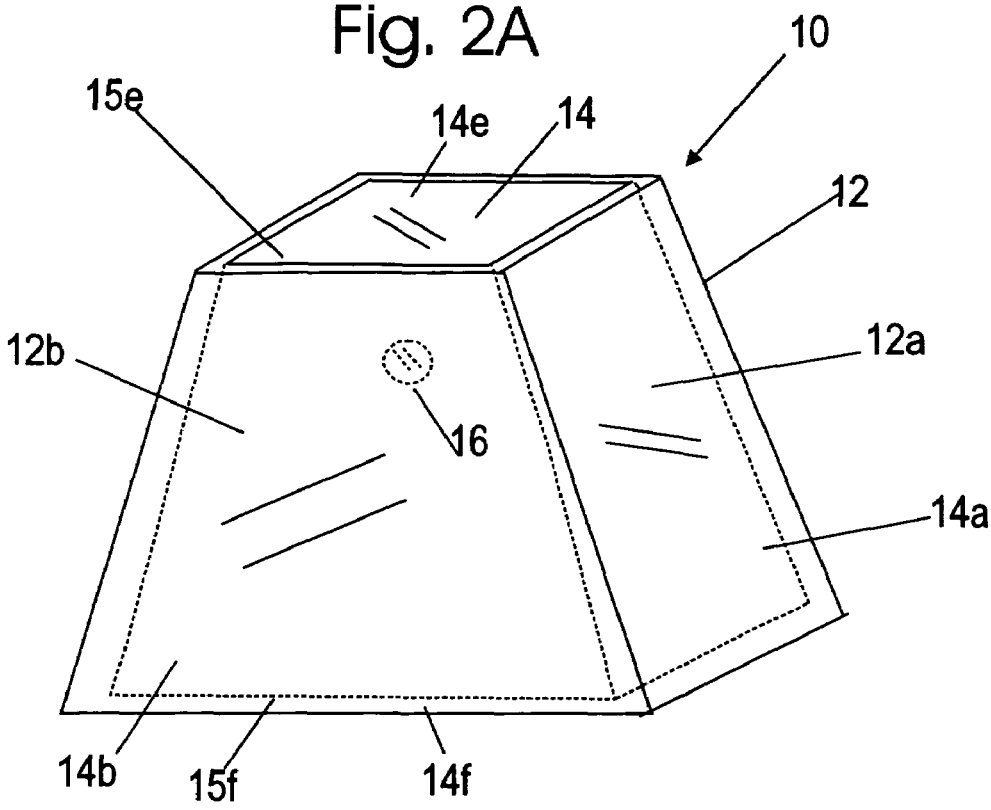
FIG. 2A shows a front perspective view of a portion of a tree trunk.
Figure 2B:
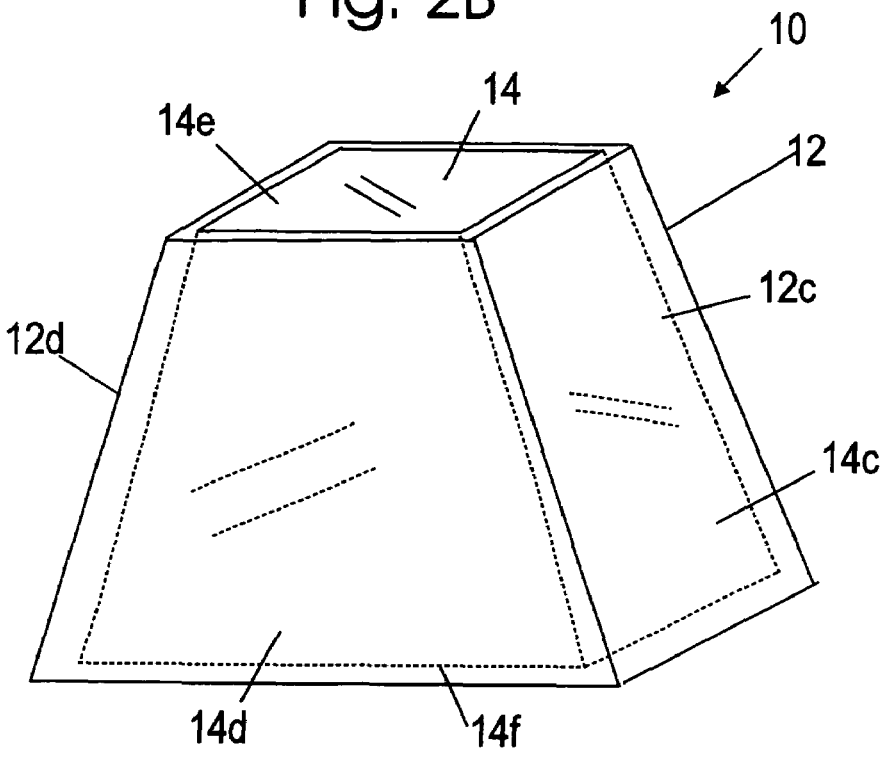
FIG. 2B shows a rear perspective view of the portion of the tree trunk of FIG. 2A.

FIG. 2A shows a front perspective view of the portion 10 of the tree trunk 5 for use in accordance with an embodiment of the present invention. The portion 10 is shown in a simplified diagram by using straight lines, however, any portion of a tree trunk, such as tree trunk 5 or any other tree trunk, can be used including a portion which has curved sides, nonuniformities, imperfections, or knots. Such uniformities serve to make each basket made in accordance with one or more embodiments of the present invention unique. FIG. 2B shows a rear perspective view of the portion 10 of the tree trunk 5 of FIG. 2A.

The portion 10 includes a bark 12 which is shown in solid lines in FIGS. 2A and 2B. The bark 12 includes portions 12*a* and 12*b* identified in FIG. 2A and portions 12*c* and 12*d* identified in FIG. 2B. The portion 10 of the trunk 5 of the tree 1 also includes an inner wood section or portion 14, which is shown by dashed lines. The inner wood section 14 may be substantially or entirely solid and may be surrounded by the bark 12. The inner wood section 14 has a top surface 14*e* and a bottom surface 14*f*, which are initially formed when the portion 10 of the tree trunk 5 is initially cut at location 15*e* shown in FIG. 1 from the portion 3 of the tree trunk 5. The top surface 14*e* may be formed by a first cut into the tree 5, which separates the portion 3 of the tree 1 above the portion 10, from the portion 10, and from tree roots 6 below the portion 10. The bottom surface 14*f* may be formed by a second cut, which may be at location 15*f*. The second cut, at location 15*f* separates the portion 10 from the roots 6 of the tree 1. The portion 10 of the tree trunk 5 may include knot, imperfection or bump 16. The portion 10 of the tree trunk 5 may include a plurality of such knots, imperfections, curves or bumps, however, one knot, imperfection or bump 16 is shown for simplification. The knot 16 may lie under the bark 12 and may push part of the bark 12 outward. The inner wood section 14 has a natural outer form, which includes sides 14*a*, 14*b* (including knot 16), 14*c*, and 14*d*. This natural outer form lies directly beneath the bark 12.

Figure 3A:
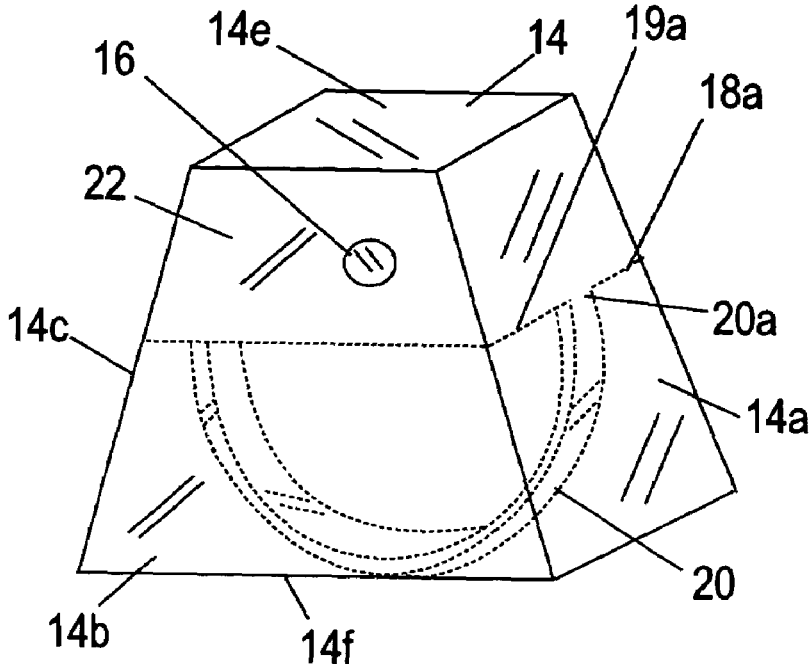
FIG. 3A shows a front perspective view of the portion of the tree trunk of FIG. 2A with the bark removed and with dashed lines showing locations to cut to make a basket.
Figure 3B:
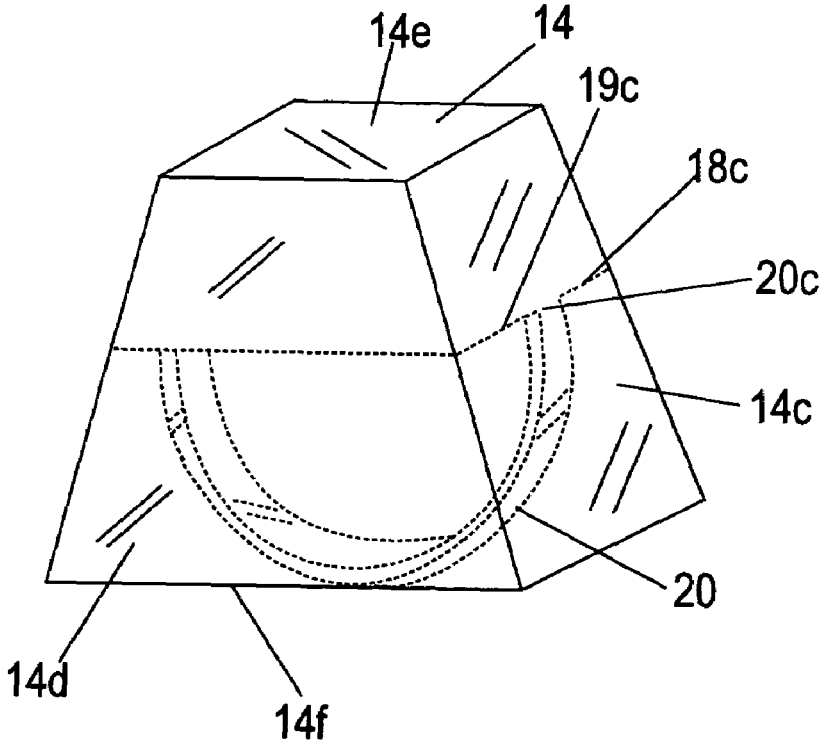
FIG. 3B shows a rear perspective view of the portion of the tree trunk of FIG. 2A with the bark removed and with dashed lines showing locations to cut to make the basket.

FIG. 3A shows a front perspective view of the portion 10 of the tree trunk 5 with the bark 12 removed and with dashed lines showing locations to cut or carve to make a basket. The piece or block of wood 14 is cut along dashed lines 18*b*, 19*a*, and 18*a* shown in FIG. 2A and along dashed lines 18*d*, 19*c*, and 18*c* shown in FIG. 2B. The piece or block of wood 14 is typically not cut all the way through but rather a handle 20, shown in dashed lines in FIGS. 2A and 2B, is typically carved out. The result is that a handle 20 is integrally formed with a portion or basket 22. The handle 20 is typically integrally connected to the portion or basket 22 at junctions 20*a* and 20*c* shown in FIGS. 3A and 3B, respectively. In some embodiments a basket or portion 22 may be formed without a handle 20. The basket portions 22*a*, 22*b*, 22*c*, and 22*d*, have a portion of the natural outer form of the sides 14*a*, 14*b*, 14*c*, and 14*d*, respectively. Part of the sides 14*a*, 14*b*, 14*c*, and 14*d* was removed to form the basket 100 in FIGS. 5A and 5B. In one embodiment, the basket portions 22*a*, 22*b*, 22*c*, and 22*d* may include part of the bark 12.

Figure 4A:
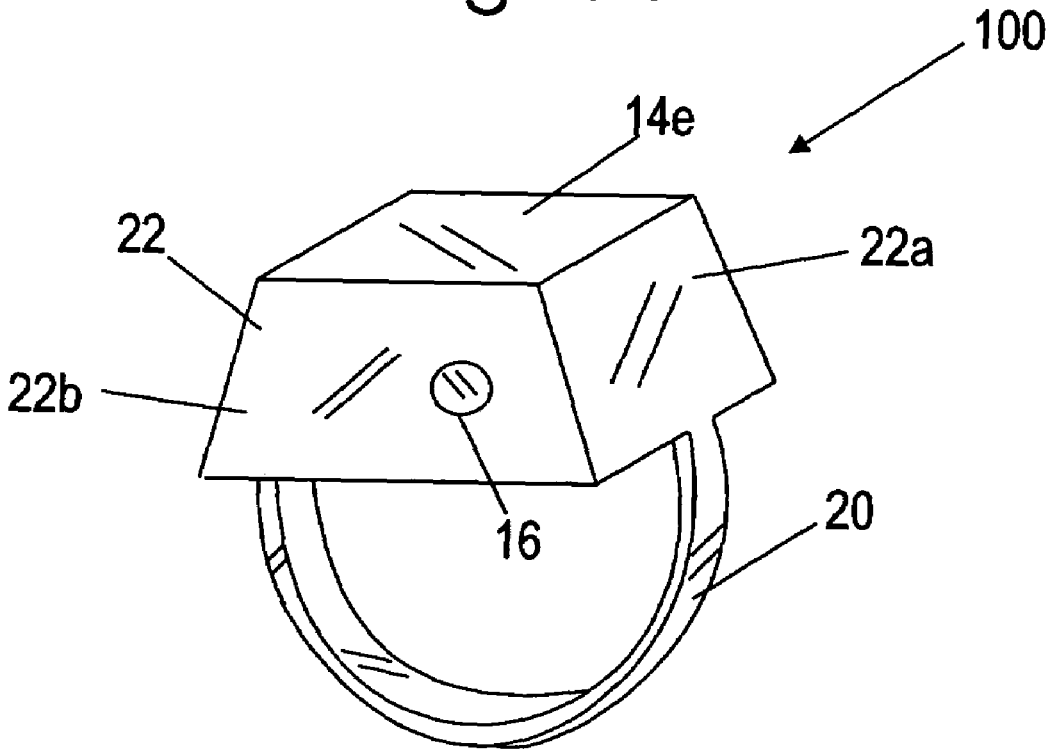
FIG. 4A shows an upside down front perspective view of the basket after it has been made from the portion of the tree trunk.
Figure 4B:
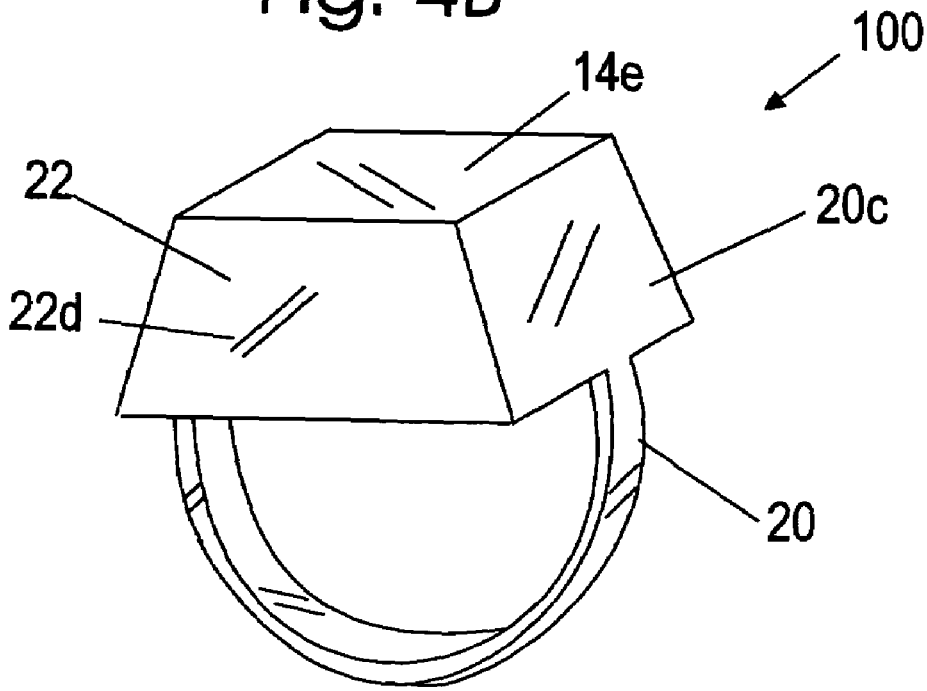
FIG. 4B shows an upside down rear perspective view of the basket after it has been made from the portion of the tree trunk.

FIG. 4A shows an upside down front perspective view of a basket 100 after it has been made from the portion 10 of the tree trunk 5. The basket 100 may include the portion or basket 22 and the handle 20. The term basket may be used to describe the portion 22 and the handle 20, together as one integrated unit, or it may be used to describe just the portion 22. FIG. 4B shows an upside down rear perspective view of the basket 100 after it has been made from the portion 10 of the tree trunk 5. The portion 22 includes sides 22*a* and 22*b* shown in FIG. 3A and sides 22*c* and 22*d* shown in FIG. 3B. The portion 22 includes side or surface 14*e*, which is the same as the top surface of block of wood 14. The side 22*b* includes the knot 16. The sides 22*a*, 22*b*, 22*c*, and 22*d* are shown as straight and uniform, with the exception of knot 16, merely to simplify description. The sides 22*a*, 22*b*, 22*c*, and 22*d* will typically follow the outside form of the portion 10 of the tree trunk 5 after the bark 12 has been removed. The sides 22*a*, 22*b*, 22*c*, and 22*d* may thus have a variety of shapes, curves, knots imperfections, bumps etc, depending on the shape of the natural outside form of the inner wood section 14 of the portion 10 of the tree trunk 5. In one embodiment, the sides 22*a*, 22*b*, 22*c*, and 22*d* may include part of the bark 12 and may take on the natural outside form of part of the bark 12.

Figure 5A:
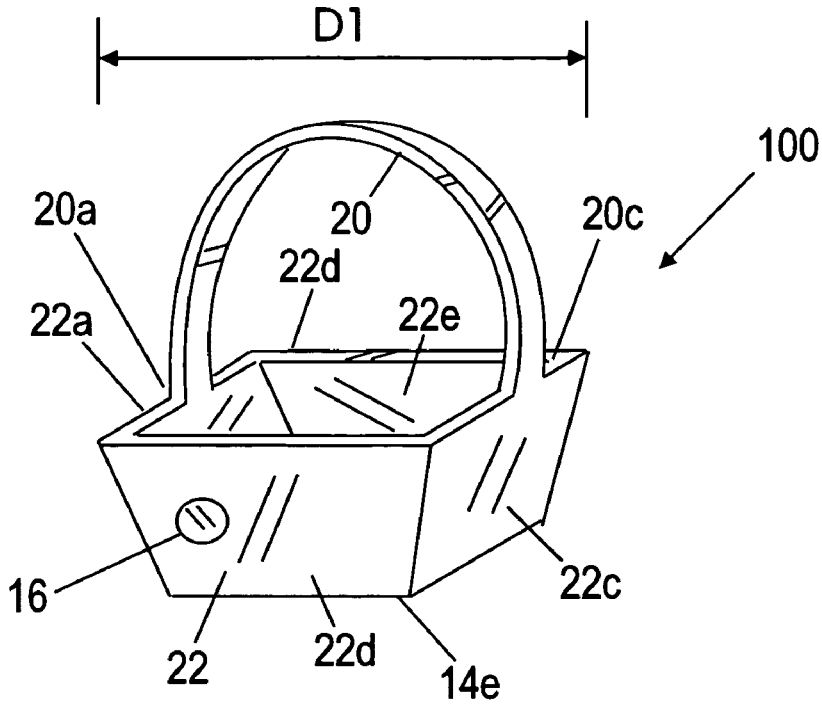
FIG. 5A shows a right side up front perspective view of the basket after it has been made from the portion of the tree trunk.
Figure 5B:
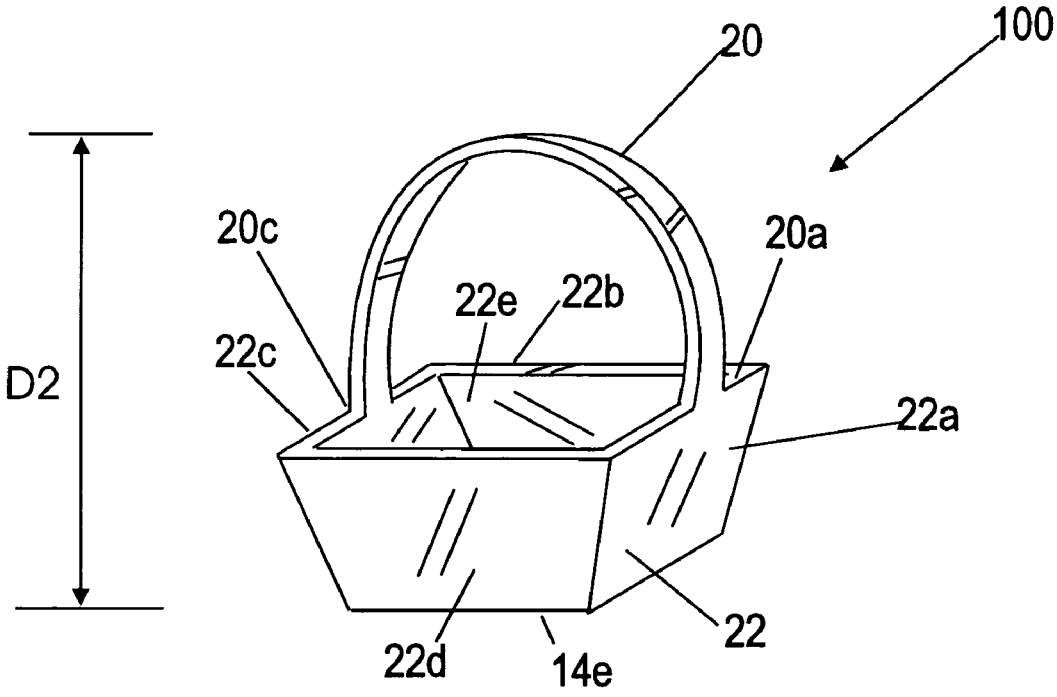
FIG. 5B shows a right side up rear perspective view of the basket after it has been made from the portion of the tree trunk.

FIG. 5A shows a right side up front perspective view of the basket 100 after it has been made from the portion 10 of the tree trunk 5. FIG. 5B shows a right side up rear perspective view of the basket 100 after it has been made from the portion 10 of the tree trunk 5. The portion 22 includes a hollowed out area 22*e*, which is open at the top to allow insertion of objects, and which is surrounded by sides 22*a*, 22*b*, 22*c*, and 22*d*, and closed at the bottom by surface 14*e*.

The tree 1 may be a Chinese Cedar Tree or any other tree. A stain may be applied to the basket 100 to color the basket 100 from a lighter more natural color to a dark brown. A diameter or width D2, shown in FIG. 5A, of the portion or basket 22 may range from ten inches to thirty inches depending on the size of the trunk of the tree. The height, or D2 shown in FIG. 5B of the basket 100 from the surface 14*e* to the top of handle 20 may be D2, which may be five to twenty-five inches.

The bark or bark section 12 may be left on and the natural outer form of the bark 12 may form at least part of the outer surface of a basket. In such an embodiment, bark 12 would cover part or all of sides 22*a*, 22*b*, 22*c*, and 22*d* of the basket 100 or a basket similar to basket 100. Also, a portion can be taken from any part of the trunk of a tree not just the bottom of the trunk of the tree. In another embodiment a basket can be made from a branch of a tree. Typically, regardless the portion of the tree that the basket comes from, or whether bark is left on, each basket will be unique because it will include a unique natural outer form of either the bark of the tree or an inner wood section of the tree, lying directly beneath the bark of the tree.

In one embodiment the portion 50 of the branch 7 of the tree 1 shown in FIG. 1, can be cut out of the tree 1. The portion 50 can be used to form a basket in the same manner that the basket 100 was formed from the portion 10 of the trunk 5. Cuts can be made at locations 50*a* and 50*b*, shown in dashed lines to cut out the portion 50. Typically a surface formed by cutting at location 50*a* will be smaller than the surface formed by cutting at location 50*b*. Typically, as for the portion 10, the location of the smaller cut will be the location of the bottom the basket to be formed. In this manner the basket will typically flare outwards from the bottom of the basket towards the junction of the handle of the basket. For example, FIGS. 5A and 5B show that sides 22*a*, 22*b*, 22*c*, and 22*d* of the basket or portion 22 flare out from the bottom 14*e* to the handle junctions 20*a* and 20*c*. In a similar manner sides of a basket formed by portion 50 of branch 7 would typically flare out from the bottom the basket to the junctions of the handle of the basket.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A basket made from a predetermined tree trunk having an inner wood section and an outer wood section formed by bark of said tree trunk for surrounding said inner wood section, wherein said basket comprises:

a tree-made portion, which has:

a top surface formed by a first cut of said tree trunk across said inner wood section and said outer wood section;

a bottom surface formed by a second cut of said tree trunk across said inner wood section and said outer wood section, wherein said top surface is spacedly apart from said bottom surface; and a portion body integrally extended between said top surface and said bottom surface, and defines a cavity within said portion body, wherein a physical contour of said portion body follows a natural geometrical contour of such portion of said tree trunk between said first cut and said second cut, so that an appearance of said tree-made portion constitutes a natural appearance of said tree trunk for carrying an object within said hollow cavity, wherein said portion body further has an inner portion layer formed by said inner wood section of said tree-trunk for forming said cavity within said portion body, and an outer portion layer which is formed by said outer wood portion of said tree trunk to constitute said corresponding natural appearance of said portion body as said natural appearance of said outer wood portion of said tree trunk, wherein said tree-made portion comprises a handle integrally extended from said portion body for allowing said portion body to be carried via said handle, wherein said handle is formed by carving said tree trunk at said top surface of said tree-made portion.

2. The basket, as recited in claim 1, wherein said portion body further has at least one kind of natural imperfection formed thereon for naturally imparting said portion body with said natural imperfection of said tree trunk.

3. The basket, as recited in claim 1, which is manufactured by a method comprising the steps of:

(a) providing a tree trunk having an inner wood section and an outer wood section formed by bark of said tree trunk for surrounding said inner wood section;

(b) forming a first cut by first cutting said tree trunk across said inner wood section and said outer wood section to form a top surface of said basket;

c) forming a second cut by second cutting said tree trunk across said inner wood section and said outer wood section at a position spacedly apart from said first cut to form a bottom surface of said basket; and (d) carving a portion body from said tree trunk between said top surface and said bottom surface, in such a manner that said portion body is integrally extended between said top surface and said bottom surface, and defines a cavity within said portion body, wherein a physical contour of said portion body follows a natural geometrical contour of such portion of said tree trunk between said first cut and said second cut, so that an appearance of said tree-made portion constitutes a natural appearance of said tree trunk for carrying an object within said hollow cavity.

4. The basket, as recited in claim 2, which is manufactured by a method comprising the steps of:

(a) providing a tree trunk having an inner wood section and an outer wood section formed by bark of said tree trunk for surrounding said inner wood section;

(b) forming a first cut by first cutting said tree trunk across said inner wood section and said outer wood section to form a top surface of said basket;

(c) forming a second cut by second cutting said tree trunk across said inner wood section and said outer wood section at a position spacedly apart from said first cut to form a bottom surface of said basket; and (d) carving a portion body from said tree trunk between said top surface and said bottom surface, in such a manner that said portion body is integrally extended between said top surface and said bottom surface, and defines a cavity within said portion body, wherein a physical contour of said portion body follows a natural geometrical contour of such portion of said tree trunk between said first cut and said second cut, so that an appearance of said tree-made portion constitutes a natural appearance of said tree trunk for carrying an object within said hollow cavity.

5. A method of manufacturing a basket, comprising the steps of:

(a) providing a tree trunk having an inner wood section and an outer wood section formed by bark of said tree trunk for surrounding said inner wood section;

(b) forming a first cut by first cutting said tree trunk across said inner wood section and said outer wood section to form a top surface of said basket;

(c) forming a second cut by second cutting said tree trunk across said inner wood section and said outer wood section at a position spacedly apart from said first cut to form a bottom surface of said basket;

(d) carving a portion body from said tree trunk between said top surface and said bottom surface, in such a manner that said portion body is integrally extended between said top surface and said bottom surface, and defines a cavity within said portion body, wherein a physical contour of said portion body follows a natural geometrical contour of such portion of said tree trunk between said first cut and said second cut, so that an appearance of said tree-made portion constitutes a natural appearance of said tree trunk for carrying an object within said hollow cavity; and (e) carving a handle at said top surface of said portion body, wherein said is integrally extended from said portion body for allowing said portion body to be carried via said handle.

6. The method, as recited in claim 5, further comprising a step of forming at least one kind of natural imperfection on said portion body for naturally imparting said portion body with said natural imperfection of said tree trunk.

7. The method, as recited in claim 5, wherein said portion body further has an inner portion layer formed by said inner wood section of said tree-trunk for forming said cavity within said portion body, and an outer portion layer which is formed by said outer wood portion of said tree trunk to constitute said corresponding natural appearance of said portion body as said natural appearance of said outer wood portion of said tree trunk.

8. The method, as recited in claim 6, wherein said portion body further has an inner portion layer formed by said inner wood section of said tree-trunk for forming said cavity within said portion body, and an outer portion layer which is formed by said outer wood portion of said tree trunk to constitute said corresponding natural appearance of said portion body as said natural appearance of said outer wood portion of said tree trunk.

* * * * *